US006302050B1

(12) United States Patent
Ziehm

(10) Patent No.: US 6,302,050 B1
(45) Date of Patent: Oct. 16, 2001

(54) OUTDRIVE GUARD

(76) Inventor: Fritz Ziehm, 47026 Jefferson, Chesterfield, MI (US) 48047

( * ) Notice: Subject to any disclaimer, the term of this patent is extended or adjusted under 35 U.S.C. 154(b) by 0 days.

(21) Appl. No.: 09/479,582

(22) Filed: Jan. 7, 2000

(51) Int. Cl.[7] ..... B63B 17/00
(52) U.S. Cl. ..... 114/343; 114/361
(58) Field of Search ..... 114/343, 362, 114/361; 440/53

(56) References Cited

U.S. PATENT DOCUMENTS 3,010,124 11/1961 Dawson .
3,805,722 * 4/1974 Melchert, Jr. et al. ..... 114/343
4,372,243 * 2/1983 Roope, Jr. ..... 114/364
4,669,414 6/1987 Molino .
4,993,978 2/1991 Johannes .
4,998,496 * 3/1991 Shaw, III ..... 114/122
5,224,437 7/1993 Stanescu .
5,409,409 * 4/1995 Blanchard et al. ..... 440/54
5,560,312 10/1996 McPherson .
5,660,136 8/1997 Pignatelli et al. .
5,829,380 11/1998 Smith .

* cited by examiner

*Primary Examiner*—Sherman Basinger
(74) *Attorney, Agent, or Firm*—Young & Basile, PC

(57) ABSTRACT

A marine outdrive guard for shielding persons from undesired contact with a watercraft outdrive unit or outboard motor. The guard includes a shield member attached to a swim platform or transom and covers the outdrive particularly when the outdrive or outboard motor is in a raised position.

15 Claims, 3 Drawing Sheets

OUTDRIVE GUARD

FIELD OF THE INVENTION

The present invention relates to marine accessories and, more particularly, to devices that shield persons from undesired contact with an outdrive or outboard motor on a watercraft.

BACKGROUND OF THE INVENTION

Over the years, growing numbers of individuals have chosen to spend their leisure time pleasure boating on inland lakes and open waters. Primary leisure activities associated with pleasure boating are swimming and water skiing. An objective of watercraft designs is to permit easy and safe entrance and exit from the water onto the pleasure boat or watercraft.

Accessory designs specifically crafted for entering and exiting the water in the form of swim ladders and the like are known in the art. One popular device on both small and large watercraft is a swim platform. Swim platforms are typically permanent platforms that extend rearward from a lower portion of the rear or transom of the watercraft and allow one or more swimmers to easily push or pull themselves in and out of the water.

It is popular for watercraft operators intending to swim to maneuver and anchor their watercraft in relatively shallow water so swimmers can casually wade in the water and touch the bottom of the lake or sea while swimming. In order to maneuver in shallow water, the outboard motor or outdrive portion of stern drive systems that protrude and extend rearward of the transom of watercraft must be raised or angled upward so the propeller or water jet propulsion system is less likely to contact the bottom of the lake.

A common problem, and one of great concern for boat owners and users alike, is that when the outdrive is in a raised or angled position, often a large portion of the outdrive and, in particular, the propeller blades, extend rearward past the swim platform. Of farther concern is that raised the outdrive propeller is usually just slightly below the surface of the water and not readily visible to swimmers intending to enter the water from the swim platform This is a further concern on larger vessels having two or more outdrives. In all but the largest of watercraft, at least a portion of the raised outdrive remains exposed beyond the swim platform. In the smallest of pleasure craft, not having swim platforms, a portion of the outdrive is exposed even in the fully down or lowered position.

Prior boating accessories such as U.S. Pat. No. 5,660,136 enclose or cover a portion of the outdrive or lower unit of an outboard motor through use of boots or cushioned bags which are placed around the outdrive to protect the outdrive from damage and to protect swimmers from undesired contact with the unit. Such boots or covers are problematic in that the boot only covers a portion of the outdrive unit and leaves the upper portion uncovered and subject to contact by swimmers or watercraft users. Further, such boots are complex in configuration, are difficult to install and remove from the outdrive and are subject to damage if the watercraft propulsion system is engaged while the boot is installed.

Consequently, it would be desirable to provide an outdrive guard improving the problematic conditions that is inexpensive to manufacture, easy to use and provides increased safety and peace of mind for boat owners, passengers and swimmers.

SUMMARY OF THE INVENTION

The inventive guard of the present invention comprises a shield member that attaches to the rear of a marine watercraft, preferably to a swim platform, and extends rearward to prevent undesirable contact of persons with the outdrive.

In a preferred aspect of the invention, the shield member is of sufficient length and width to fully extend over any portion of the outdrive that may extend beyond the swim platform or transom. The shield is attached to a mounting surface preferably on the rear of the watercraft or to a swim platform by at least one mounting bracket. The mounting bracket preferably includes a pin for attachment of the shield to a receptacle that is attached to the swim platform The mounting bracket allows free rotation of the shield about the pin which enables the shield to rotate down and come to rest in a vertical position, or more typically, in an angled position on the raised outdrive extending beyond the swim platform or transom.

In an additional preferred aspect of the invention, the shield member is a substantially rigid panel attached to the swim platform or transom as described immediately above.

In another preferred aspect of the invention, the mounting bracket includes a biasing member, which biases the pin into the receptacle for positive engagement of the shield to the swim platform while allowing rotation of the shield as described above. This facilitates quick and easy installation and removal of the shield from the swim platform These and other features and advantages of the invention win be apparent upon reading the following specification which, along with the drawings, describes and discloses preferred and alternative aspects of the invention in detail.

BRIEF DESCRIPTION OF THE DRAWING

The description herein makes reference to the accompanying drawings wherein like reference numerals refer to like parts throughout the several views, and wherein.

DESCRIPTION OF THE INVENTION

Figure 1:
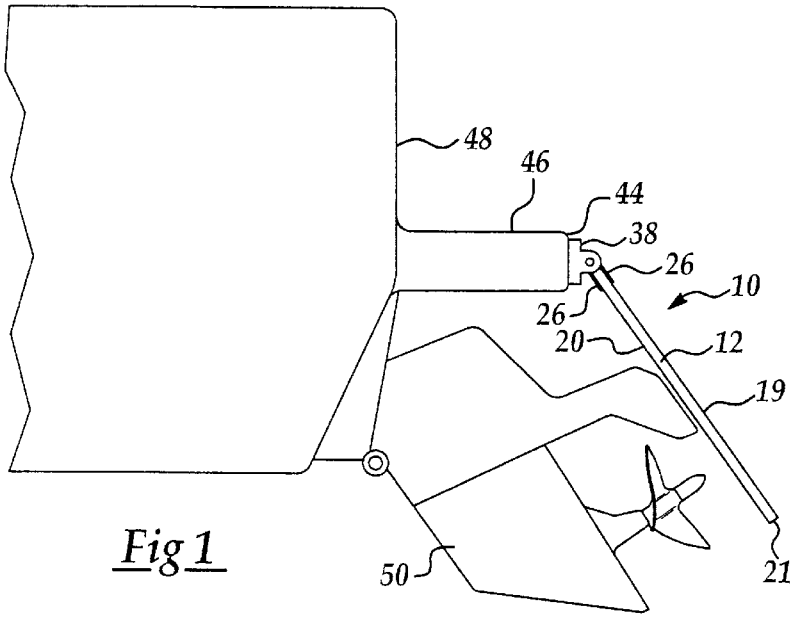
FIG. 1 is a side view of a guard according to the present invention installed on the rear edge of a swim platform of a watercraft.
Figure 2:
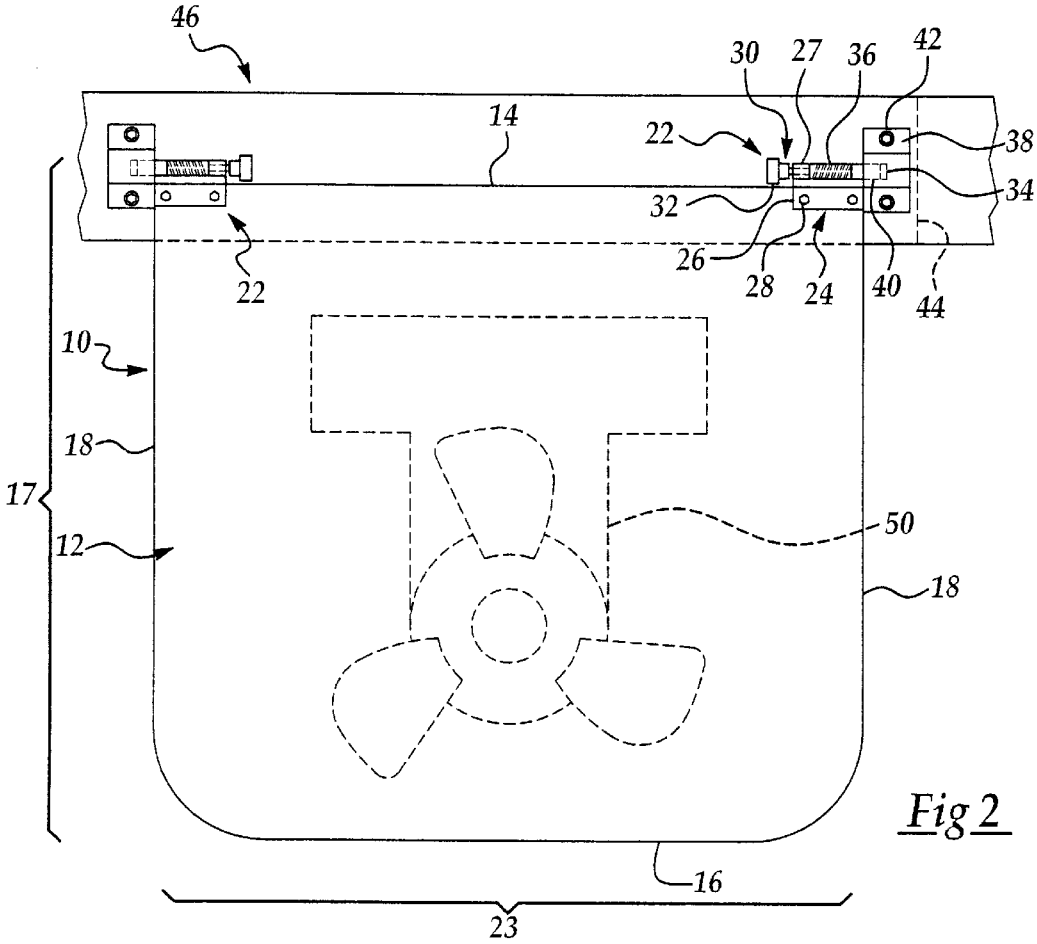
FIG. 2 is a rear view of the guard positioned in a vertical or down position with respect to a platform.

Referring to FIGS. 1–6, an outdrive guard of the present invention is illustrated. Referring to FIG. 2, outdrive guard 10 is comprised of a shield member 12 and a mounting bracket 22. The outdrive guard 10 is attached to a rear surface 44 of the watercraft.

As used herein, the term outdrive includes an outdrive unit of marine stern drive systems as commonly known in the art as well as outboard motors including the lower unit extending below the engine or powerhead.

The shield member 12 comprises an upper or first edge 14 and an opposing lower or second edge 16 defining a length 17 of shield member 12. The shield 12 also includes opposing side edges 18 adjacent the first and second edges 14 and 16 respectively. The side edges 18 define a width 23 of shield 12. As seen in FIG. 2, the shield member 12 preferably has a square or rectangular shape although the shield 12 can take many shapes, such as a polygonal configuration without deviating from the present invention.

Figure 6:
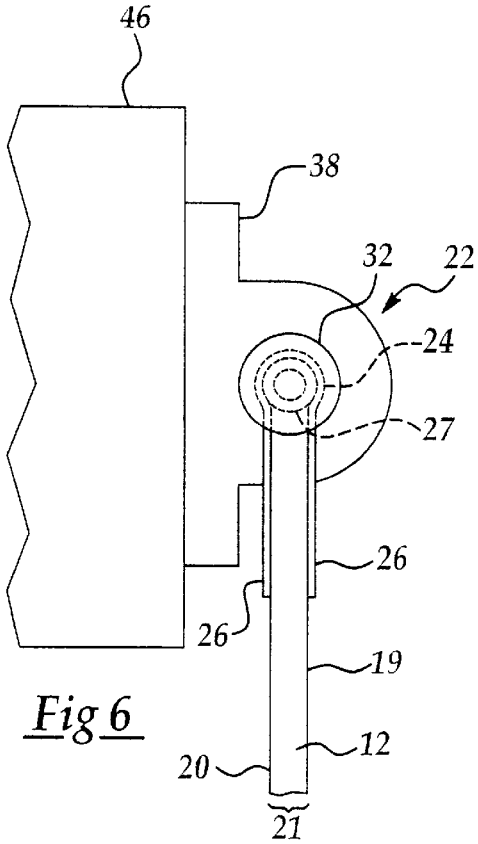
FIG. 6 is an enlarged partial side view of the mounting bracket of the guard shown in FIGS. 1–5.

As shown in FIGS. 1 and 6, the shield 12 is preferably of a relatively small gauge or thickness 21 in comparison to the length 17 and width 23 of shield 12. The shield 12 is preferably made from a substantially rigid material that maintains the desired shape but is resistant to fracture, damage from impact and weather. Exemplary materials include marine grade polymer sheet and LEXAN, although other like substantially rigid materials not listed will suffice. It is further contemplated that non-rigid materials may also be used for the shield member 12 to prevent undesired contact with outdrive 50. Exemplary materials may include elastomers such as rubber or flexible polymers.

Figure 3:
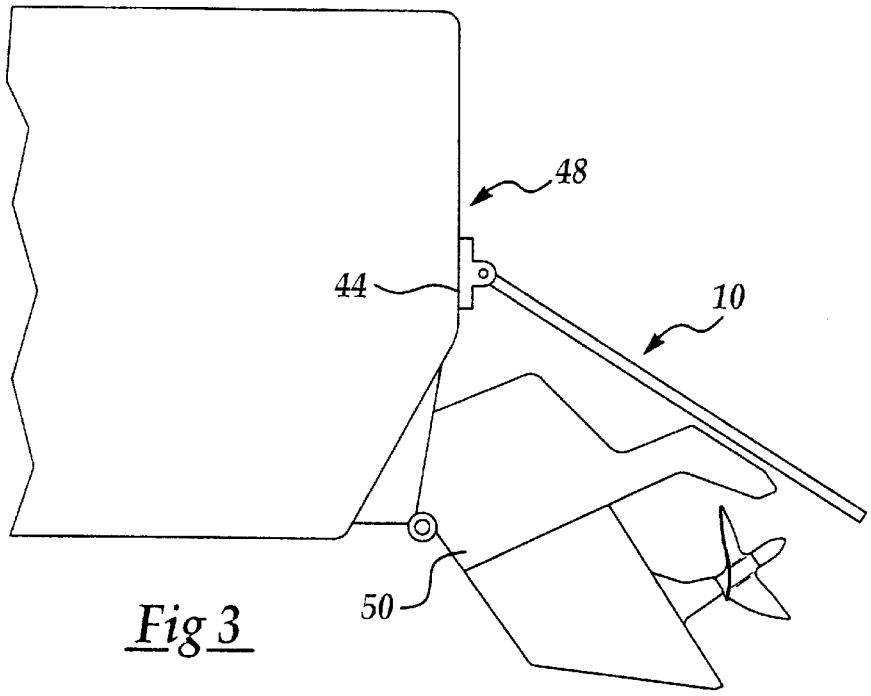
FIG. 3 is a side view of the guard in an alternate aspect of the invention where the guard is installed on the transom of a watercraft.
Figure 4:
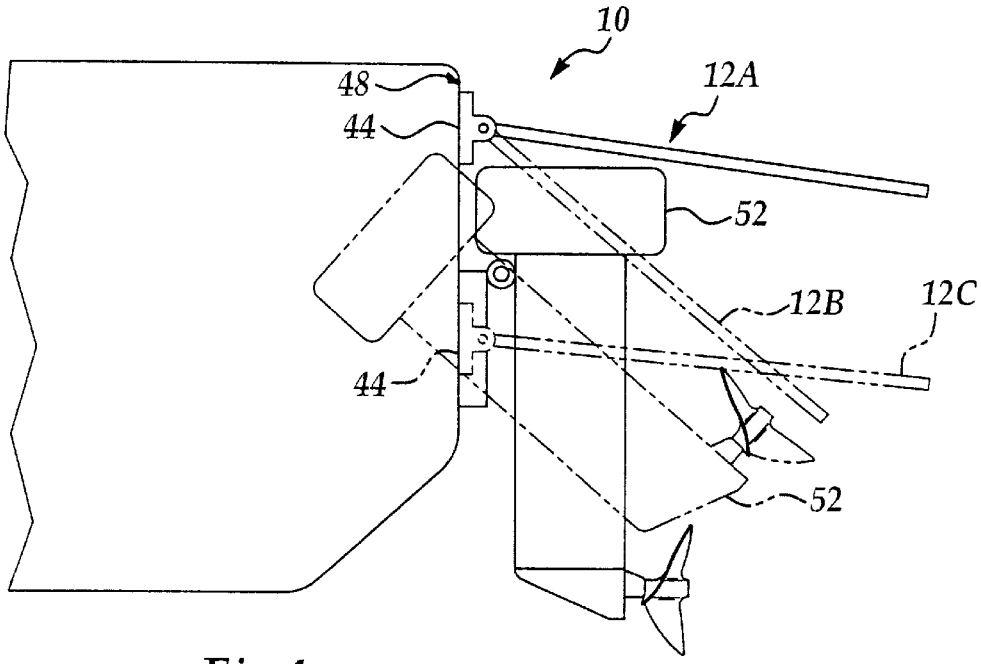
FIG. 4 is a side view of the guard in an alternate aspect where the guard is installed on the transom for use with an outboard motor.
Figure 5A:
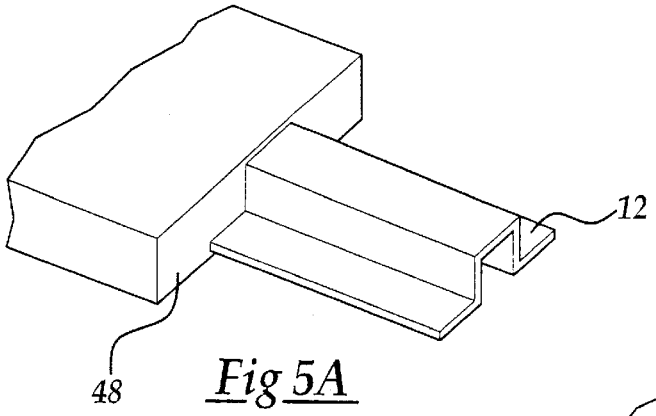
FIGS. 5*a*–5*c* illustrate perspective views of exemplary alternate configurations of the shield member of the outdrive guard.
Figure 5B:
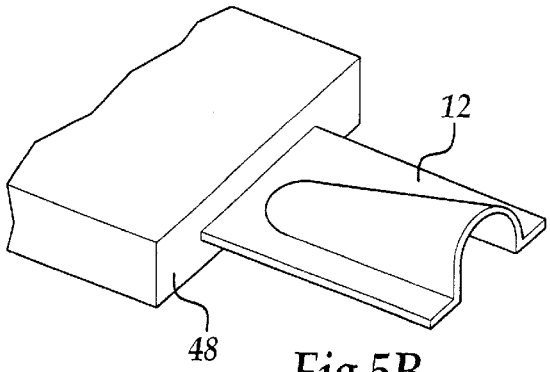
Figure 5C:
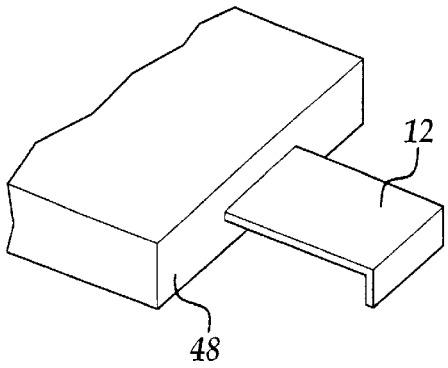

FIGS. 1–6 also illustrate the shield 12 as preferably a substantially planar and flat sheet. In alternate aspects of the invention the shield 12 may include bends or forms resulting in a change of cross section both as to length 17 and width 23. As illustrated in FIG. 5, alternate exemplary shapes may include an inverted flanged "U" shape (FIG. 5*a*) a partial dome or tunnel (FIG. 5*b*), or an "L" shape (FIG. 5*c*), or a combination of such exemplary forms or shapes to suit the particular watercraft, outdrive or application. The shield 12 could also be made from or marked with an highly visible material or color to further enhance its visibility to users.

Referring now to FIG. 1, shield 12 is preferably attached to the rear surface 44 of the watercraft and most preferably on the rear vertical surface of a swim platform 46. In the perceived most typical application of the guard 10, the shield 12 is preferably attached to a swim platform 46 on a watercraft including a stern drive system having an outdrive 50 protruding through and extending rearward of the watercraft transom 48. As shown in FIG. 1, the outdrive 50 is in a raised position and extends a distance beyond the rear edge of the swim platform 45 and the rear surface 44. In this application, the shield 12 is positioned at a downward angle and rests on top of the outdrive 50. As shown in FIG. 3, alternate applications of the guard 10 for use with the outdrive 50 provides for attachment of guard 10 directly to transom 48 where there is no swim platform 46 above the outdrive 50.

In other alternate applications of the guard 10, the shield 12 may be is used on watercraft employing an outboard motor drive system as shown in FIG. 4. In this aspect, the guard 10 is mounted to the watercraft transom 48 preferably above the outboard motor 52. When the outboard 52 is in the down or lowered position, the shield 12*a* rests at a shallow angle on top the outboard motor powerhead. In this aspect, a shield of a shorter length 17 may be used. Upon raising or tilting the outboard 52, shown in phantom line, such as when the watercraft is in shallow water, shield 12*b* would be lowered to a greater angle and rest on the raised lower unit or outdrive of 52. In another alternate application using an outboard motor 52, the guard 10 can be attached to transom 48 below the outboard motor powerhead and the shield 12*c* would include an opening to allow the lower unit of outboard 52 to pass through the shield (not shown). In this aspect, the shield 12 would lower and rest on outboard 52 in a position as shown at 12*c*. This position is less desirable as the powerhead and upper portion of the lower unit of outboard 52 would not be completely shielded from undesired contact.

Referring back to FIG. 2, guard 10 includes a mounting bracket 22 which attaches shield 12 to the rear surface 44 on the watercraft, preferably the swim platform 46. As shown in FIG. 2, two mounting brackets 22 are preferably used for each shield 12. In a preferred aspect, each mounting bracket 22 comprises a pivot bracket 24 having two mounting plates 26 which are positioned on opposing sides 19 and 20 near first edge 14 of shield member 12 as most clearly shown in FIG. 6. Pivot bracket 24 also includes a through bore 27. Pivot bracket 24 is attached to shield 12 using common fasteners for example screws, bolts and nuts, rivets, or through other mechanical methods such as heat or mechanical staking processes. It is also contemplated that pivot bracket 24 could be bonded to shield 12 through adhesives or molded directly into the shield 12.

In a preferred aspect shown in FIG. 2, each mounting bracket 22 includes an elongate pin 30 having an enlarged first end 32 and an opposed second end 34. The pin 30 is positioned in through bore 27 of pivot bracket 24. Pivot bracket 24 allows pin 30 to slide within bore 27 and permits pivot bracket 24 and shield member 12 to freely rotate about pin 30 Mounting bracket 22 also preferably comprises a receptacle 38 which is attached to the watercraft rear surface 44, preferably on a swim platform 46, by common fasteners and methods described above. Receptacle 38 includes an opening 40 for receipt and sliding engagement of the second end 34 of pin 30.

In a preferred aspect, mounting bracket 22 further includes a biasing member 36 within through bore 27 of pivot bracket 24. Biasing member 36 is preferably a coil spring as shown in FIG. 2 and naturally biases the second end 34 of pin 30 outward from pivot bracket 24 and into opening 40 of receptacle 38 attached to the watercraft.

Upon installation of the preferred guard 10, the enlarged ends 32 of pins 30 are pulled toward one another overcoming the force of biasing members 36. Shield member 12 is positioned between receptacles 38 attached to rear surface 44 and the pins 30 are aligned with receptacle openings 40. The pins 30 are then released and the biasing members 36 automatically force and engage the second ends 34 of pins 30 into the receptacle openings 40. In this position, shield 12 is fully supported by the receptacles 38 allowing free rotation of shield 12 about pins 30. Removal of the guard is accomplished by overcoming the force from biasing members 36 and displacing the second ends 34 of pins 30 from the receptacle openings 40.

Although the preferred guard 10 is shown including two mounting brackets 22 per each shield member 12, and includes biasing members 36, it is understood by those sidled in the art that rotational attachment of shield 12 to the watercraft may be accomplished in many equivalent ways.

In operation, guard 10 is attached to a watercraft in the manner described above. In a preferred application on the watercraft having an outdrive 50 as shown in FIGS. 1 and 3, guard 10 can be installed regardless of a position of the outdrive. If the outdrive is in the fully down or lowered position, shield 12 is allowed to freely rotate to a vertical position with little or no contact of shield 12, and more specifically, inner surface 20, with the outdrive 50. In the event the watercraft enters shallow water and the outdrive 50 is raised, the outdrive 50 contacts the inner surface 20 of the shield 12 which freely rotates the shield about pins 30 to accommodate the position of the outdrive 50 and maintain coverage of the outdrive from undesired contact.

As shown in FIGS. 1–4, the length 17 of the shield 12 is designed to extend at least as far from rear surface 44 to cover the rearwardmost portion of the outdrive 50 or outboard 52 regardless of position. Likewise, the width 23 of the shield 12 is designed to extend at least as far outboard to fully cover the width of outdrive 50 or outboard 52 to prevent persons or objects from contacting the outdrives from the watercraft or swim platform. On larger watercraft employing two or more outdrives, one or more guards 10 may be employed to cover the outdrives in the manner described.

The guard 10 is as easily installed or removed when the outdrive 50 or outboard 52 is in the fully raised, fully lowered, or at any position therebetween. Desirably, the guard 10 of the present invention can remain installed indefinitely while the watercraft is stationary or in motion. While the watercraft is in motion, guard 10 freely rotates upward to accommodate the flow of water or thrust from the outdrive 50.

What is claimed is:

1. A watercraft outdrive guard for use on a watercraft having an outdrive extending from a rear surface, the guard comprising:

a shield member having an edge; and at least one mounting bracket for releasably and rotatably attaching said edge of said shield member to a rear surface on said watercraft such that said shield freely rotates about said edge to an operative outdrive guard position at a downward angle from said rear surface to shield persons from contacting said outdrive.

2. The guard of claim 1 wherein said shield member has a length between opposed edges, said length being at least as great as a distance that said outdrive extends beyond said rear surface.

3. The guard of claim 2 wherein said shield further comprises opposing side edges defining a width of said shield, said shield width being at least as great as a width of said outdrive.

4. The guard of claim 1 wherein said shield member is substantially rigid.

5. The guard of claim 4 wherein said shield member is substantially planar.

6. The guard of claim 1 wherein said mounting bracket further comprises at least one pin and at least one receptacle for receiving a portion of said pin, said mounting bracket allowing free rotation of said shield member about said pin relative to said watercraft rear surface.

7. The guard of claim 6 wherein said mounting bracket further comprises a biasing member to bias said pin into said receptacle.

8. A watercraft outdrive guard for use on a watercraft having an outdrive extending from a rear surface, the guard comprising:

a shield member having a first and an opposing second edge defining a length of said shield, and opposing side edges adjacent said first and said second edges defining a width of said shield; and at least one mounting bracket for releasably and rotatably attaching said first edge of said shield to a watercraft rear surface such that said length of said shield member is at least as great as a distance that said outdrive extends beyond said rear surface and said width of said shield member is at least as great as a width of said watercraft outdrive, said shield freely rotates about said first edge to an operative outdrive guard position abutting said outdrive at a downward angle from said rear surface over the outdrive to shield persons from contacting said outdrive.

9. The guard of claim 8 wherein said shield member is substantially rigid.

10. The guard of claim 9 wherein said shield member is substantially planar.

11. The guard of claim 9 wherein said shield member is a continuous panel.

12. The guard of claim 8 wherein said mounting bracket further comprises a pivot bracket having a pin and a receptacle for receiving a portion of said pin.

13. The guard of claim 12 wherein said receptacle is attached to said watercraft rear surface and said pivot bracket is attached to said first edge of said shield member, said mounting bracket allowing free rotation of said shield member about said pin relative to said watercraft rear surface.

14. The guard of claim 12 wherein said pivot bracket includes a biasing member for biasing said pin into said receptacle.

15. A watercraft outdrive guard for use on a watercraft having an outdrive extending from a rear surface, the guard comprising:

a substantially rigid shield member having a first and an opposing second edge defining a length of said substantially rigid shield, and opposing side edges adjacent said first and said second edges defining a width of said substantially rigid shield; and at least one mounting bracket for releasably and rotatably attaching said first edge of said shield to said watercraft rear surface, said mounting bracket including a pivot bracket having a pin and a receptacle, said receptacle attaching to said rear surface of said watercraft above said outdrive for receipt of said pin, said mounting bracket allowing free rotation of said shield about said pin to an operative outdrive guard position at a downward angle from said watercraft rear surface in abutting engagement with said outdrive to shield persons from contacting said outdrive.

* * * * *